United States Patent [19]

Theurer

[11] Patent Number: 4,905,604

[45] Date of Patent: Mar. 6, 1990

[54] MOBILE SWITCH LEVELING, LINING AND TAMPING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 333,710

[22] Filed: Apr. 5, 1989

[30] Foreign Application Priority Data

Aug. 8, 1988 [AT] Austria ..... A1994/88

[51] Int. Cl.[4] ..... E01B 27/17

[52] U.S. Cl. ..... 104/7.2; 104/7.1; 104/10; 104/12

[58] Field of Search ..... 104/2, 7.1, 7.2, 8, 104/10, 12

[56] References Cited

U.S. PATENT DOCUMENTS

| | | | |
|---|---|---|---|
| 3,534,687 | 10/1970 | Theurer et al. | 104/2 |
| 3,990,154 | 11/1976 | Theurer et al. . | |
| 4,186,804 | 2/1980 | Theurer et al. | 104/7.1 |
| 4,270,456 | 6/1981 | Theurer et al. | 104/2 |
| 4,323,013 | 4/1982 | Theurer . | |
| 4,342,263 | 8/1982 | Hurni . | |
| 4,625,651 | 11/1986 | Theurer | 104/7.2 |
| 4,627,360 | 12/1986 | Theurer et al. . | |
| 4,825,768 | 5/1989 | Theurer et al. | 104/7.2 |

FOREIGN PATENT DOCUMENTS 2140061 11/1984 United Kingdom .

*Primary Examiner*—Andres Kashnikow
*Assistant Examiner*—M. Cunningham
*Attorney, Agent, or Firm*—Kurt Kelman

[57] ABSTRACT

A mobile switch leveling, lining and tamping machine comprises a vertically and laterally adjustable leveling and lining tool carrier frame linked to the machine frame, a pair of flanged wheels supporting the carrier frame on a main track for mobility therealong, each flanged wheel engaging a respective rail and serving as a track lining tool, a respective power-operated, vertically and transversely adjustable track lifting tool mounted on the carrier frame for gripping each rail at one side thereof, a leveling and lining reference system including a main track position sensing device, the leveling and lining reference system controlling actuation of the track lifting and lining drives in response to the main track position sensed by the device, a vertically adjustable auxiliary device mounted on the machine frame for lifting a laterally adjacent track section, a power-actuated drive for laterally displacing the auxiliary device, and a measuring carriage associated with the machine and running on the laterally adjacent track section, the measuring carriage comprising a measuring beam extending transversely from the laterally adjacent track section to the machine frame for measurably monitoring the position of the laterally adjacent track section and a cross level connected to the measuring beam for measurably monitoring the superelevation of the adjacent track section.

11 Claims, 1 Drawing Sheet

MOBILE SWITCH LEVELING, LINING AND TAMPING MACHINE

BACKGROUND OF THE INVENTION (1) Field of the Invention

The present invention relates to a mobile switch leveling, lining and tamping machine for vertically and laterally adjusting the position of a track switch comprised of a main track consisting of two rails fastened to ties, each rail having a field side and a gage side, and a track section laterally adjacent the main track, the machine comprising a machine frame, a leveling and lining tool carrier frame linked to the machine frame, power-actuated track lifting and lining drive means connecting the carrier frame to the machine frame for vertically and laterally adjusting the carrier frame, a pair of flanged wheels supporting the carrier frame on the main track for mobility therealong, each flanged wheel engaging a respective one of the rails and serving as a track lining tool, a respective power-operated, vertically and transversely adjustable track lifting tool mounted on the carrier frame for gripping each rail at one side thereof, and a leveling and lining reference system including a main track position sensing device, the leveling and lining reference system controlling actuation of the track lifting and lining drive means in response to the main track position sensed by the device.

(2) Description of the Prior Art

U.S. pat. No. 4,627,360, dated Dec. 9, 1986, discloses a machine of this type. The transversely adjustable tamping unit of this machine has tamping tools which may be independently pivoted in planes extending transversely to the track to enable even the most difficult areas of a track switch to be tamped by at least one of the tamping tools while any tamping tool encountering an obstacle is pivoted out of the way. To enable even very heavy switches with complicated rail configurations to be gripped for vertical and lateral movement, the track leveling and lining unit, which is supported on the track by two pairs of flanged rollers, has a strong rail-engaging lifting hook for each rail and these lifting hooks are transversely and vertically adjustable by hydraulic cylinder-piston drives. This enables the hooks to engage either the head or the base of each rail. Such switch leveling, lining and tamping machines are of great importance in track maintenance and rehabilitation work because the proper leveling and lining of track switches is very valuable due to the high cost of building such switches. However, despite the control of the leveling and lining operations by the reference system of the machine, the accuracy of the track lifting to obtain the desired level is impaired because of the weight of the adjacent track section branching off the main track in the switch and attached thereto by long ties, which causes an imbalance to the left or the right of the main track. Therefore, it is often necessary to re-work the branch track section and to adjust its level again under the control of the reference system before the ties of the adjacent track section are tamped.

U.S. pat. No. 4,323,013, dated Apr. 6, 1982, also discloses a mobile track leveling, lining and tamping machine which may be used in tangent tracks as well as in track switches. This machine comprises a track leveling and lining tool carrier frame which has a projecting center pole linked to the machine frame and is supported by a pair of flanged wheels on the track, which also serve as lining tools. Two lifting and two lining drives link the carrier frame to the machine frame to transmit the required leveling and lining forces to the track. A rail gripping device at each side of each flanged wheel comprises a pair of gripping rollers pivotal into and out of gripping engagement with the field and gage sides of the associated rail. Furthermore, a vertically and transversely adjustable rail gripping hook is arranged between the pairs of gripping rollers to enable even the heaviest switches to be lifted. In one embodiment, only a single pair of gripping rollers is associated with each gripping hook. In this arrangement, each rail is securely clamped between the flanged wheel engaging the gage side of the rail and at least one gripping roller and/or hook engaging the field side of the rail even in very difficult track configurations. However, while these machines have been used with great success, the unbalance produced by the branch track in the switch results in the hereinabove-outlined disadvantages and often subjects the lifting and/or lining drives to excessive stress. In an effort to alleviate this, it has been proposed to equip the machine with hoists providing an auxiliary support for the branch track section but this involves additional operating personnel and impedes the progress of the operation considerably. The hoists must be engaged and disengaged intermittently as the machine advances from tie to tie for tamping, which is very time-consuming and makes the operation uneconomical.

Still another mobile track leveling, lining and tamping machine has been disclosed in U.S. pat. No. 4,342,263, dated Aug. 3, 1982, which incorporates a two-part leveling and lining tool carrier frame with a lower carrier frame part whose central pole is linked to the machine frame and whose rear portion has a pair of flanged rollers supporting the carrier frame on the track. The upper carrier frame part is centrally linked to the lower part and carries a respective transversely displaceable and pivotal lifting hook associated with each flanged roller. The upper part is vertically adjustable on the lower part to make the lifting hooks vertically adjustable. The tool carrier frame is longitudinally adjustable relative to the machine frame. Since only a single rail gripping tool is provided for each rail, this machine cannot be used for lifting heavy track sections, such as switches, nor can it handle difficult rail configurations occurring in track switches. The previously described disadvantageous imbalance produced during lifting by the branch track is even more noticeable in this arrangement.

The track leveling and lining unit of the leveling, lining and tamping machine disclosed in British patent No. 2,140,061, published Nov. 21, 1984, similarly has a single pair of flanged wheels supporting the unit on the track rails and serving as lining tools, and a rail gripping hook or roller gripping the field side of each rail associated with each lining tool. This arrangement has the above-indicated disadvantages.

An apparatus for measuring the lateral distance between adjacent tracks has been disclosed in U.S. pat. No. 3,990,154, dated Nov. 9, 1976. This apparatus may be mounted on a track liner and enables the position of an adjacent track to be surveyed while the track liner advances. The apparatus comprises a roller head engaging one rail of the adjacent track and being telescopingly arranged for displacement transversely to the track to indicate position measurements of the adjacent track. It also comprises a measuring axle connected to the track liner engageable without play with a selected rail of the track and generating an electrical measuring signal. This apparatus enables the lateral distance of the adjacent track to be accurately measured and recorded, for example while the track liner is in operation.

SUMMARY OF THE INVENTION

It is the primary object of this invention to improve a mobile switch leveling, lining and tamping machine of the first-described type for operation in particularly heavy track switch areas where the branch track is still connected to the main track by long ties so that the switch may be very accurately leveled and lined in these areas in an economical manner.

The above and other objects are accomplished according to the invention in such a machine which comprises a vertically adjustable auxiliary device mounted on the machine frame for lifting the laterally adjacent track section, a power-actuated drive for laterally displacing the auxiliary device, and a measuring carriage associated with the machine and running on the laterally adjacent track section. The measuring carriage comprises a measuring beam extending transversely from the laterally adjacent track section to the machine frame for measurably monitoring the position of the laterally adjacent track section and a cross level connected to the measuring beam for measurably monitoring the superelevation of the adjacent track section.

With this machine, the adjacent track section may be lifted in an accurately controlled manner by the auxiliary lifting device and the measuring carriage while the main track is leveled and lined under the control of the reference system. Since the measuring carriage with its measuring beam and cross level provides a very simple measuring system, it may be readily put into and out of operation as the machine approaches and leaves the area of the switch where the branch track has to be leveled with the main track. In addition, since the cross level continuously monitors the superelevation of the adjacent track, excessive tie tamping and raising of the main track is avoided. The robust arrangement of the present invention makes it possible to level and line the main and branch tracks accurately in a single operation in an area of the switch where the connecting ties may be as long as 7 m.

BRIEF DESCRIPTION OF THE DRAWING

The above and other objects, advantages and features of this invention will become more apparent from the following detailed description of certain now preferred embodiments thereof, taken in conjunction with the somewhat schematic drawing wherein.

DETAILED DESCRIPTION OF PREFERRED EMBODIMENTS

Figure 1:
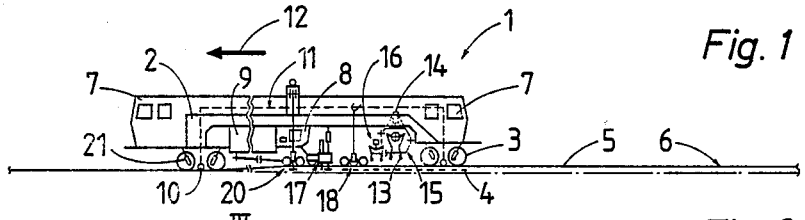
FIG. 1 is a side elevational view of a switch leveling, lining and tamping machine according to the invention.

Referring now to the drawing, there is shown mobile switch leveling, lining and tamping machine 1 for vertically and laterally adjusting the position of a track switch comprised of main track 6 consisting of two rails 5 fastened to ties 4, each rail having a field side and a gage side, and laterally adjacent track section 19. Machine 1 comprises machine frame 2 and widely spaced undercarriages 3 supporting the machine frame on the main track for mobility therealong in an operating direction indicated by arrow 12. An operator's cab 7 is mounted on machine frame 2 at each end thereof and operator's cab 8 as well as central power source 9 for all operating drives of the machine are mounted on the machine frame between the undercarriages. Leveling and lining tool carrier 17 is linked to the machine frame by power-actuated track lifting and lining drives 59 connecting the carrier frame to the machine frame for vertically and laterally adjusting the carrier frame. A pair of flanged wheels supports the carrier frame on main track 6 for mobility therealong, each flanged wheel engaging a respective rail 5 and serving as a track lining tool. A respective power-operated, vertically and transversely adjustable track lifting tool, such as a lifting hook 60 or a pair of lifting rollers, is mounted on the carrier frame for gripping each rail 5 at one side thereof. The machine further has leveling and lining reference system 11 including main track position sensing device 10, the leveling and lining reference system controlling actuation of the track lifting and lining drives in response to the main track position sensed by device 10. Tamping head 15 is mounted on machine frame 2 adjacent rear undercarriage 3 and trails leveling and lining tool carrier frame 17 in the operating direction. The switch tamping head is vertically adjustably linked to the machine frame by vertical adjustment drive 14 and comprises reciprocable and vibratory pairs of tamping tools 13 for tamping ballast under ties 4, the tamping tools being pivotal for raising them out of the way of obstacles encountered thereby when immersed in the ballast in the switch area. All of this structure is well known and various effective components useful in this machine have been described and illustrated in detail in the prior art patents mentioned hereinabove.

According to this invention, the machine further comprises vertically adjustable auxiliary device 20 mounted on machine frame 2 for lifting laterally adjacent track section 19, power-actuated, i.e. hydraulic, drive 28 for laterally displacing auxiliary device 20 and measuring carriage 18 associated with machine 1 and running on laterally adjacent track section 19 between tamping head 15 and carrier frame 18. Auxiliary lifting device 20 is mounted on machine frame 2 for rotation about vertical axis 28 so that it may be operable at a selected longitudinal side of the machine frame for lifting an adjacent track either at the right side or the left side of main track 6. Support cylinders 21 connect each undercarriage 3 to machine frame 2 at respective sides of the machine frame for absorbing the asymmetrical additional lifting forces transmitted from the auxiliary track lifting device to the machine frame during lifting of the adjacent track. The measuring carriage comprises measuring beam 24 extending transversely from machine frame 2 to laterally adjacent track section 19 for measurably monitoring the position of the laterally adjacent track and cross level 25, embodied in an electrical pendulum device 51 in the preferred embodiment, connected to the measuring beam for measurably monitoring the superelevation of adjacent track section 19.

Figure 3:
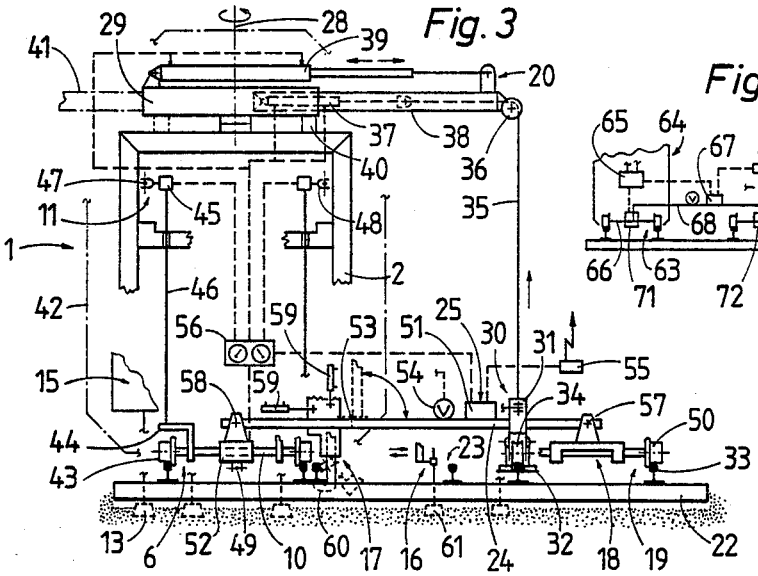
FIG. 3 is a cross section along line III—III of FIG. 2, at an enlarged scale, illustrating the major operating components of the main track leveling and lining reference system, the measuring carriage with the measuring beam and the auxiliary track lifting device.

As best shown in FIG. 3, flanged rollers 50 support measuring carriage 18 for mobility along laterally adjacent track section 19 and main track position sensing device 10 comprises a transversely extending measuring axle with sensing rods 46 vertically adjustably mounted in brackets affixed to machine frame 2. Cross level 52, also embodied in an electrical pendulum device, is connected to the measuring axle for monitoring the superelevation of main track 6 and flanged rollers 43 support the measuring axle on rails 5, measuring beam 24 being connected to the measuring axle. Electrical pendulum cross levels 51 and 52 are connected to central control panel 56 in operator's cab 8. The ends of measuring beam 24 are articulated to the measuring axle and to the measuring carriage, respectively, at joints 58 and 57 which preferably detachably connect the measuring beam to the measuring axle and to the measuring carriage.

The detachable connection of the measuring beam to the measuring axle of the main track leveling and lining reference system simply and directly connects the surveying systems of the main track and the laterally adjacent track so that the structure provided by the present invention may be readily retrofitted into existing switch leveling, lining and tamping machines and the measuring carriage may be selectively connected to either side of the machine. At the same time, it enables the superelevation of the two adjacent tracks to be monitored in the same track plane. Electrical pendulums mounted on the measuring axle and beam provide a dependably accurate measurement of the superelevation despite the discontinuous impacts of the track lifting strokes. Since measuring carriage 18 runs on laterally adjacent track section 19 between tamping head 15 and carrier frame 18, an accurate control of the superelevation and level of track section 19 can be obtained in transverse alignment with the leveling and tamping of main track 6.

Figure 2:
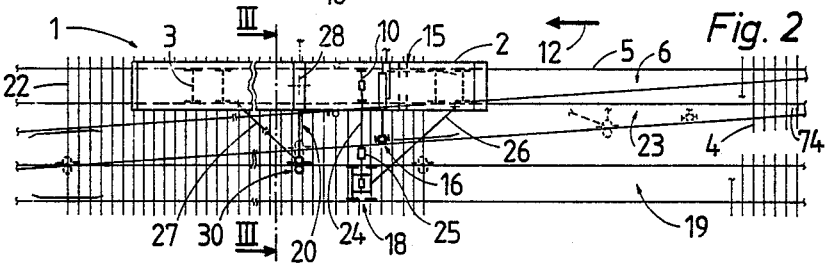
FIG. 2 is a top view of the machine of FIG. 1 on the main track and also shows the adjacent track section with the measuring carriage thereon.

As shown in FIG. 2, main track 6 is connected to adjacent parallel track 19 by long ties 22. Furthermore, branch track 23 leads from the main track to the adjacent track, schematically indicated guide rails being provided at the points where the branch track branches off from the main track and leads into the adjacent track. Connecting rods 26 and 27, respectively, connect measuring carriage 18 and auxiliary lifting device 20 to machine frame 2. As shown, measuring carriage 18 is arranged immediately behind leveling and lining tool carrier frame 17 in the operating direction and auxiliary lifting device 20 is arranged immediately preceding the carrier frame in the operating direction. A respective auxiliary tamping head 16 is arranged at each side of the machine frame for working at an adjacent track either to the left or the right of the main track, to which side auxiliary lifting device 20 has been rotated, the auxiliary tamping head being arranged behind the auxiliary lifting device in the operating direction for tamping ties of the adjacent track. This arrangement enables the lifting of the adjacent track to be measured accurately, and the auxiliary tamping head will enable the ties of the adjacent track to be tamped at least provisionally at the common level of the main and adjacent tracks in a single operating stage.

As shown in FIG. 3, auxiliary lifting device 20 comprises cantilever arm 29 mounted on machine frame 2 for rotation about vertical axis 28 and hoist 30 supported on this arm. The hoist comprises rail lifting elements 32 consisting of a pair of pivotal rail clamping rollers mounted on carriage 31 supported by flanged rollers 34 on rails 33 of adjacent track 19. Carriage 31 is detachably connected to machine frame 2 by rod 27. One end of hoisting rope 35 is connected to carriage 31 while an opposite end thereof is connected to the piston rod of vertical adjustment drive 37 mounted in carrier arm 38 telescopingly received in cantilever arm 29. The hoisting rope is trained intermediate its ends about guide roller 36 affixed to an outer end of carrier arm 38. Drive 39 connects carrier arm 38 to cantilever arm 29 so that the carrier arm with vertical adjustment drive 37 may be extended or retracted transversely to the track. To improve the force transmission and relieve stresses on vertical axis 28, support 40 is affixed to machine frame 2 to provide a support for the cantilever arm. Phantom lines 41 indicate the rotational position of cantilever arm 29 of auxiliary lifting device 20 at the opposite side of the main track and phantom lines 42 indicate the profile of the main track within which cars must fit to avoid unduly projecting laterally into the adjacent track.

Measuring axle 10 is supported on rails 5 of main track 6 by flanged rollers 43 and carries L-shaped support brackets 44 on which sensing rods 46 are mounted. The sensing rods extend above each rail through bores in guide brackets affixed to machine frame 2 so that they are freely vertically movable in accordance with the track level sensed by rollers 43, and they carry rotary potentiometers 45. Fork-shaped sensing element 48 is connected to each potentiometer and receives tensioned wire 47 of leveling and lining reference system 11 to indicate the existing level of each rail of track 6. Another fork-shaped sensing element 49 is connected to a rotary potentiometer for receiving tensioned wire 49 of the reference system to indicate the lateral position of the track. The structure and operation of such track leveling and lining reference systems is well known.

Figure 4:
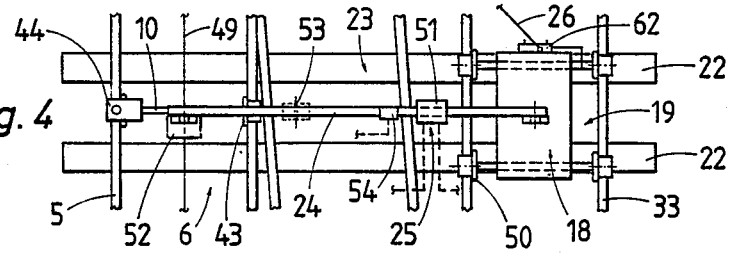
FIG. 4 is a top view showing the measuring axle of the main track leveling and lining reference system, the measuring beam connected thereto and the measuring carriage on the adjacent track.

As shown in broken lines in FIGS. 3 and 4, hinge 53 including a locking stop connects measuring beam 24 to measuring axle 10 alongside a longitudinal side of the machine frame. This hinge connection provides a simple means for putting the measuring beam into and out of operation simply by lowering or raising the measuring beam. If the joint connections 57, 58 are detachable, the measuring carriage with the measuring beam may be quickly removed after the machine has passed the switch.

Control indicating instrument 54 is mounted on measuring beam 24 for visual observation of the superelevation monitored by electrical pendulum cross level 51. Mobile remote control 55, for example a radio or like control, is provided for actuating drives 37, 39 of hoist 30. The visual observation of the monitored superelevation enables an operator of the remote control immediately and accurately to control the lifting of the adjacent track and to observe the operation of the hoist.

Deviating from FIGS. 1 and 2, FIG. 3 shows tamping tools 13 of tamping head 15 and tamping tools 61 of auxiliary tamping head 16 immersed in the ballast for simultaneously tamping of long tie 22.

As shown in FIG. 4, interconnected measuring axle 10 and measuring beam 24 extend transversely across main track 6 and adjacent parallel track 19. In operation, the measuring beam is lowered about hinge 53 and locked in position while it is raised into a rest position when the work on the adjacent track has been completed. For this purpose, the measuring beam and measuring carriage 18 are relatively light, for instance of aluminum. A hydraulically operated spreading cylinder 62 is mounted on measuring carriage 18 to press one or the other flanged roller 50 against the associated rail 33 to provide a firm lining reference base. Rod 26 detachably connects the measuring carriage to machine frame 2 to move the measuring carriage in tandem with the machine frame along adjacent track 19 as machine 1 advances along main track 6, thus relieving any stress on measuring beam 24.

Figure 5:
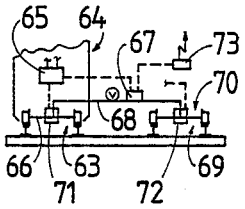
FIG. 5 is a view similar to that of FIG. 3, at a reduced scale, and showing another embodiment of the machine.

FIG. 5 shows an embodiment wherein mobile switch leveling, lining and tamping machine 64, which is of substantially the same construction as machine 1, runs on main track 63. Machine 64 is equipped with central control panel 65 and, in addition to the measuring axle of the leveling and lining reference system, has another measuring axle 66 supported on the rails of main track 63 by flanged rollers. Measuring carriage 70 runs on laterally adjacent track 69 and comprises measuring beam 68 extending transversely from the laterally adjacent track to the machine frame of machine 64 for measurably monitoring the positions of the laterally adjacent track section and the main track, and cross level 67 connected to measuring beam 68 for measurably monitoring the superelevations. At main track 63, the measuring beam is connected with measuring axle 66. Additional cross levels 71 and 72 are connected, respectively, to the measuring axle and measuring carriage 70. As in the first-described embodiment, the auxiliary lifting device of machine 64 is actuated by a mobile remote control 73. The measuring embodiment of FIG. 5 has the advantage that measuring beam 68, which extends over the laterally adjacent track section and the main track, may be arranged in an area of the machine which is less encumbered by other structures, for example in a location preceding the leveling and lining tool carrier frame, independently of the location of the measuring axle of the main track leveling and lining reference system. This arrangement may be readily retrofitted on existing machines.

The operation of switch leveling, lining and tamping machine 1 will now be described in detail (machine 64 operating in a like manner):

Before branch track 23 is reached, main track 6 is leveled, lined and tamped with the machine in a conventional manner as the machine advances along the main track. Leveling is normally effected from high point to high point, the high points lying at a higher level than the rails of the track switch. As soon as machine 1 has reached frog 74 where the branch track branches off the main track, auxiliary lifting device 20 with its hoist 30 is properly positioned by actuation of drives 37, 39 and is operated for lifting the branch track until the first long tie 22 has been reached in the range of a guide rail. When this tie is reached, lifting rollers 32 are pivoted into gripping engagement with inner rail 33 of laterally adjacent parallel track 19, i.e. the rail adjacent the main track. Raised measuring carriage 18 at the side of machine frame 2 is lowered by pivoting measuring beam 24 about hinge 53 until flanged rollers 50 support the measuring carriage on rails 33 of the laterally adjacent parallel track. (The positions of the lifting rollers of hoist 30 are indicated in phantom lines in FIG. 2.) Spreading cylinder 62 is actuated to sit the measuring carriage firmly on the laterally adjacent track and avoid any lateral play between flanged rollers 50 and associated rails 33. An operator located in the range of hoist 30 is in charge of mobile remote control 55 to actuate the track lifting drive while visually observing control instrument 54 indicating the superelevation. Vertical adjustment drive 37 of hoist 30 is actuated at the same time as leveling and lining drives 59 so that main track 6 and laterally adjacent track section 19 are simultaneously and uniformly lifted. Cross level 25 connected to measuring beam 24 assures that the laterally adjacent track section is not lifted higher than the main track. This measuring carriage arrangement also assures that level errors along long ties 22, which may be due to poorly positioned ties, are corrected in the correct ratio. As lifting drives 37, 59 level the main track and the laterally adjacent track, sensing rods 46 of main track leveling and lining reference system 11 will be correspondingly raised. This will cause the fork-shaped sensing elements engaging tensioned leveling and lining reference wires 47, 49, respectively, to be displaced until main track 6 has reached the correct position determined by the reference wires. Tamping head 15 and auxiliary tamping head 16 are then lowered to immerse tamping tools 13 and 61 in the ballast to tamp long tie 22, the tamping heads being transversely displaceable to enable the tamping to be effected at desired locations along the tie, i.e. at the intersections of rails 5 and ties 4 of main track 6 and at inner rail 33 of laterally adjacent track section 19. In this way, the leveled and lined main track and laterally adjacent track section are fixed in the corrected positions. After the tie has been tamped, machine 1 is advanced to the next tie, rods 26 and 27 pulling measuring carriage 18 and auxiliary lifting device 20 along to this tie while lifting rollers 32 remain engaged with the inner rail of the adjacent track section. The leveling, lining and tamping operation is now repeated from tie to tie until the entire switch has been leveled, lined and tamped.

A precision leveling and lining measurement may be used in the operation of machine 1 in switches. If the level, lining and/or superelevation errors are excessive, the switch work may be repeated in another pass of the machine over the switch. After the last long tie of the switch has been reached in the range of the guide rails, measuring carriage 18 is pivoted into its rest position at the longitudinal side of machine frame 2 and is secured thereto. If a laterally adjacent track section at the other side of machine 1 is to be worked, auxiliary lifting device 20 is turned 180° about vertical axis 28, and a second auxiliary tamping head 16 is vertically and transversely displaceably mounted on the other side of machine frame 2 for cooperating with the auxiliary lifting device at this side. Measuring beam 24, which is connected to measuring carriage 18, is detached from measuring axle 10 at joint 58 and re-attached thereto at this joint to project to the other side. Alternatively, a second measuring carriage may be mounted on the other side of the machine frame.

In this operation, branch track 23 is lifted in the area of the guide rails by auxiliary lifting device 20 after the ties in the area of frog 74 have been tamped, and every second or third tie of the branch track is tamped by auxiliary tamping head 16. After the first long tie 22 connecting main track 6 and laterally adjacent parallel track section 19 has been reached, the auxiliary lifting device is positioned for lifting the adjacent track section together with the main track in the above-described manner. If desired, the adjacent track section may subsequently be tamped again to fix it more securely in position.

What is claimed is:

1. A mobile switch leveling, lining and tamping machine for vertically and laterally adjusting the position of a track switch comprised of a main track consisting of two rails fastened to ties, each rail having a field side and a gage side, and a track section laterally adjacent the main track, the machine comprising (*a*) a machine frame, (*b*) a leveling and lining tool carrier frame linked to the machine frame, (*c*) power-actuated track lifting and lining drive means connecting the carrier frame to the machine frame for vertically and laterally adjusting the carrier frame, (*d*) a pair of flanged wheels supporting the carrier frame on the main track for mobility therealong, each flanged wheel engaging a respective one of the rails and serving as a track lining tool, (*e*) a respective power-operated, vertically and transversely adjustable track lifting tool mounted on the carrier frame for gripping each rail at one side thereof, (*f*) a leveling and lining reference system including (1) a main track position sensing device, the leveling and lining reference system controlling actuation of the track lifting and lining drive means in response to the main track position sensed by the device, (*g*) a vertically adjustable auxiliary device mounted on the machine frame for lifting the laterally adjacent track section, (*h*) a power-actuated drive for laterally displacing the auxiliary device, and (*i*) a measuring carriage associated with the machine and running on the laterally adjacent track section, the measuring carriage comprising (1) a measuring beam extending transversely from the laterally adjacent track section to the machine frame for measurably monitoring the position of the laterally adjacent track section and (2) a cross level connected to the measuring beam for measurably monitoring the superelevation of the adjacent track section.

2. The mobile switch leveling, lining and tamping machine of claim 1, further comprising flanged rollers supporting the measuring carriage for mobility along the laterally adjacent track section, the main track position sensing device comprising a transversely extending measuring axle vertically adjustably mounted on the machine frame, a cross level connected to the measuring axle for monitoring the superelevation of the main track and flanged rollers supporting the measuring axle on the rails, and the measuring beam being connected to the measuring axle.

3. The mobile switch leveling, lining and tamping machine of claim 2, wherein the cross levels are electrical pendulum devices.

4. The mobile switch leveling, lining and tamping machine of claim 2, further comprising a hinge connecting the measuring beam to the measuring axle alongside a longitudinal side of the machine frame.

5. The mobile switch leveling, lining and tamping machine of claim 2, wherein the measuring beam is detachably connected to the measuring axle.

6. The mobile switch leveling, lining and tamping machine of claim 1, further comprising two widely spaced undercarriages supporting the machine frame for mobility on the main track in an operating direction, a tamping head mounted on the machine frame between the undercarriages and trailing the leveling and lining tool carrier frame in the operating direction, and the measuring carriage with the measuring beam being arranged between the tamping head and the carrier frame.

7. The mobile switch leveling, lining and tamping machine of claim 6, wherein the measuring carriage is arranged immediately behind the leveling and lining tool carrier frame in the operating direction, the auxiliary lifting device is arranged immediately preceding the carrier frame in the operating direction, the auxiliary track lifting device including a vertical adjustment drive, and an auxiliary tamping head arranged behind the auxiliary track lifting device in the operating direction for tamping ties of the adjacent track.

8. The mobile switch leveling, lining and tamping machine of claim 7, further comprising a control indicating instrument mounted on the measuring beam for visual observation of the superelevation monitored by the cross level and a mobile remote control for actuating the vertical adjustment drive of the auxiliary track lifting device.

9. The mobile switch leveling, lining and tamping machine of claim 7, further comprising support cylinders connecting each undercarriage to the machine frame at respective sides thereof for absorbing asymmetrical additional lifting forces transmitted by the auxiliary track lifting device to the machine frame.

10. The mobile switch leveling, lining and tamping machine of claim 1, wherein the measuring beam extends transversely from the laterally adjacent track section to the main track for measurably monitoring the positions of the laterally adjacent track sections and the main track.

11. The mobile switch leveling, lining and tamping machine of claim 10, further comprising a transversely extending measuring axle and flanged rollers supporting the measuring axle on the main track rails, the measuring beam being connected to the measuring axle.

* * * * *